US008449816B2

(12) United States Patent
Seropeghin et al.

(10) Patent No.: US 8,449,816 B2
(45) Date of Patent: May 28, 2013

(54) COMPOSITION AND METHODS OF PREPARATION OF TARGET MATERIAL FOR PRODUCING RADIONUCLIDES

(75) Inventors: Yurii D. Seropeghin, Moscow (RU); Boris L. Zhuikov, Moscow Region (RU)

(73) Assignee: Brookhaven Science Associates, Upton, NY (US)

( * ) Notice: Subject to any disclaimer, the term of this patent is extended or adjusted under 35 U.S.C. 154(b) by 480 days.

(21) Appl. No.: 12/424,944

(22) Filed: Apr. 16, 2009

(65) Prior Publication Data

US 2010/0080726 A1 Apr. 1, 2010

(30) Foreign Application Priority Data

Aug. 29, 2008 (RU) ..... 2008134983

(51) Int. Cl.
*B22F 1/00* (2006.01)

(52) U.S. Cl.
USPC ..... 419/33; 419/30; 419/38; 164/48; 164/69.1; 164/57.1; 376/151; 228/101; 75/10.14; 75/228

(58) Field of Classification Search
USPC ..... 75/10.1, 10.14, 10.18, 611, 612, 75/703; 148/421, 422; 420/417–421, 576, 420/580, 590; 419/30
See application file for complete search history.

(56) References Cited

U.S. PATENT DOCUMENTS

| | | | | |
|---|---|---|---|---|
| 3,564,348 | A * | 2/1971 | Cheseldine | 361/528 |
| 5,342,283 | A | 8/1994 | Good | |
| 5,425,063 | A | 6/1995 | Ferrieri et al. | |
| 6,144,690 | A * | 11/2000 | Kusamichi et al. | 373/147 |
| 2007/0034373 | A1 | 2/2007 | McDaniel et al. | |

OTHER PUBLICATIONS

A. Kjekshus et al. On the Phase Relationships in the Titanium-Antimony System: The Crystal Structures of Ti3Sb. Acta Chemica Scandinavica 16, (1962), pp. 1493-1510.*

T.B. Massalski et al. "Ti—Sb Phase Diagram" in Binary Alloy Phase Diagram, vol. 2, American Society for Metals, published Oct. 1986, pp. 2017, 2022, 2023.*

A.Yu. Kozlov*, V.V. Pavlyuk, Investigation of the interaction between the components in the Ti—{Si, Ge}—Sb systems at 670 K, Journal of Alloys and Compounds 367 (2004) 76-79.*

* cited by examiner

*Primary Examiner* — Roy King
*Assistant Examiner* — Christopher Kessler
(74) *Attorney, Agent, or Firm* — Wood, Herron & Evans, LLP

(57) ABSTRACT

A composition suitable for use as a target containing antimony to be irradiated by accelerated charged particles (e.g., by protons to produce tin-117m) comprises an intermetallic compound of antimony and titanium which is synthesized at high-temperature, for example, in an arc furnace. The formed material is powdered and melted in an induction furnace, or heated at high gas pressure in gas static camera. The obtained product has a density, temperature stability, and heat conductivity sufficient to provide an appropriate target material.

6 Claims, No Drawings

COMPOSITION AND METHODS OF PREPARATION OF TARGET MATERIAL FOR PRODUCING RADIONUCLIDES

This invention was made with Government support under contract number DE-AC02-98CH10886, awarded by the U.S. Department of Energy. The Government has certain rights in the invention.

FIELD OF THE INVENTION

The field of the invention relates to nuclear technology and chemistry, to the production of an effective target material for irradiation by intensive accelerator beams and obtaining various radioactive isotopes from Sb-containing targets (e.g., $^{117m}$Sn, which has a medical application).

BACKGROUND

A method for the production of Sb-targets made of thin layers of enriched antimony (Sb) to be irradiated with accelerated protons is described in Mausner et al. (Mausner at al., Nuclear data for production of $^{117m}$Sn for biomedical application, J. Radiation Effects, 94, 59-63 (1986); S. V. Ermolaev at al., J. Labeled Compounds and Pharmaceuticals, 50, 611-612 (2007)). However, the thin layers of antimony did not result in a high amount of produced $^{117m}$Sn on accelerated proton beams.

Another method is based on target preparation from thick antimony monolith in a target shell (B. L. Zhuikov et al., Process and targets for production of no-carrier added radiotin, Russian Patent No. 2313838 (published Dec. 27, 2007)). However, pure Sb is a material with a low heat conductivity and thermal stability, and melts, and sublimes under intensive proton beams.

In other reports (C. Loch et al., "A New Preparation of Germanium-68", Int. J. Appl. Radiat. Isot., 33, 261-270 (1982); N. R. Stevenson at al., A New Production Method for Germanium-68, Synthesis and Application of Isotopically Labelled Compounds, Ed. J. Allen, John Willey & Sons, 1995, p. 119-223; A. A. Razbash et al., "Production of Germanium-68 in Russia", Proc. 6$^{th}$ Workshop on Targetry and Target Chemistry, Vancouver, Canada, 1995, p. 5114), GaNi alloys were used as target material for production $^{68}$Ge. Also uranium-magnesium oxide composition as a target material was used for production of $^{99}$Mo on nuclear reactors (I. S. Kurina et al., Device for Producing Radionuclides, Russian Patent No. 2122251 (published Nov. 20, 1998)). However, Sb-target material in these reports was not mentioned or considered for use.

SUMMARY OF THE INVENTION

The present invention includes a method for production of intermetallic compositions of antimony and titanium by high-temperature synthesis in an arc furnace, melting the obtained material in an induction furnace at 1160-1500° C. in a vacuum or in inert gas. After melting in induction furnace the melt is poured out into a pattern which is preheated to a temperature no more than 200° C. Alternately, the product obtained in the arc furnace is powdered, the powder is pressed, and then heated in an induction furnace holding the pressed powder suspended in a magnetic field to melt. After melting, the magnetic field is removed and the melt is poured out into a pattern at a temperature also not more than 200° C.

In still another embodiment, the material produced in the arc furnace is cooled and powdered to a particle size not more than 100 μm, the powder is enclosed into a metallic container made of material with a melting point less than 1500° C., and heated in a gas static camera under high pressure not less than 90 MPa for at least 1 hour.

These and other embodiments will be apparent from the following detailed description and examples.

DETAILED DESCRIPTION

According to the present invention, an alloy is formed wherein the alloy comprises titanium and antimony (primarily TiSb) which can be used to produce radioactive isotopes such as $^{117m}$Sn. TiSb has a high thermal stability: melting point is 1160° C. (J. L. Murray, Binary Alloy Phase Diagrams, Second Edition, Ed. T. B. Massalski, ASM International, Materials Park, Ohio 3, p. 3311-3312 (1990)) and heat of formation 167 kJ/Mol (A. R. Miedema, N. V. Philips, On the heat of formation of solid alloys, J. Less-Common Metals, 46, 67-83 (1976)). In the formation of the intermetallic composition contains antimony not less than 40 atomic % (63 weight %) and not more than 50 atomic % (72 weight %). A higher concentration of Sb may lead to the presence of pure antimony at heating, while a lower concentration of antimony reduces the production rate of radioactive isotopes from irradiated antimony-containing target. An antimony concentration of not less than 48 atomic % (70 weight %) and not more than 49 atomic % (71 weight %) is preferred. A higher amount of Sb may lead to the presence of pure antimony at heating while a lower amount of Sb considerably decreases the production rate of the radioactive isotopes from the irradiated antimony-containing target. The ratio of Ti:Sb which is close to 50 atomic % also provides a higher melting point, i.e., 1160° C., in the composition, which is important for temperature stability.

The antimony may be enriched antimony ($^{121}$Sb or $^{123}$Sb) for future isotope production or may be natural antimony.

In an exemplary embodiment, intermetallic TiSb-composition forms a massive block comprising a monolith with density not less than 95% of X-ray density of the compound. Lower densities lead to a lower heat conductivity and mechanical strength.

The intermetallic can be produced in an arc furnace by blending the powdered metals and melting them at a temperature of about 1500° C. for 0.2 to 0.5 minutes. This can be repeated two to three times to produce more of the material. The formed alloy is then melted in an induction furnace at 1160-1500° C. in vacuum at a pressure no greater than $10^{-2}$ torr, or in inert gas of purity no fess than 99%. The melting point of the main compound in the composition TiSb is 1160° C., while at temperatures higher than 1500° C. some loss of antimony due to evaporation is possible. Higher pressures or less pure gas may lead to oxidation, which may decrease the integrity of the intermetallic After melting in the induction furnace the melt is poured out into a pattern at a temperature not more than 200° C. Higher pattern temperatures may cause the formation of gaps and caves in the final material.

Alternately, the product obtained in the arc furnace may be powdered. The powder is then pressed and heated in an induction furnace suspended in a magnetic field to melt. After the melting, the magnetic field is removed and the melt is poured out into a pattern again with a temperature not more than 200° C.

Alternately, the material produced in the arc furnace may also be cooled and powdered to a particle size of not more than 100 μm. The powder can be enclosed in a metallic container made of material with a melting point not less than 1500° C., and heated to a temperature of 800-1000° C., more particularly 880-950° C., in a gas static camera. The container should have thick walls. If the container material has a melting point less than 1500° C., the deformation parameters are not acceptable. In order to avoid additional impurities, especially tin in case of production no-carrier-added $^{117m}$Sn, titanium or titanium alloy can be used as the container material, wherein it can contain not less than 98% of titanium and no tin.

In order to obtain compact material, the pressure in the gas static camera should be 90 MPa (900 bar) and the minimal time of heating can be 1 hour. Suitable results can be achieved at heating with gas pressure 90-150 MPa during 3-9 hours, or, with a shorter time of heating at a pressure at least 150 MPa during 1-3 hours. At lower pressures or shorter heating time, a less compact material is obtained. At higher pressures or longer heating times, crystallite growth can occur, leading to formation of structured defects and worsening of mechanical properties.

After one or more of the aforementioned procedures, the obtained material can be cut in order to observe the structure of the material and prepare a target of acceptable design for irradiation by charged particle beams.

The invention will be further appreciated in light of the following examples.

EXAMPLE 1

TiSb was synthesized in an arc furnace with unspent tungsten electrodes and a copper water-cooled tray in an atmosphere of purified argon by heating a mixture of powders of pure titanium and antimony in 1:1 atomic ratio. The heating was performed at approximately 2500° C. for 0.2-0.5 minutes. The regulus of the obtained alloy was turned over and melted again 2-3 times. The obtained samples of the material 5-12 g in weight each contained abscesses and caves.

The material obtained in the arc furnace was powdered and then melted in an alumina crucible in a high-frequency (induction) furnace at 1160-1500° C. in vacuum ($10^{-3}$ torr). Heating in pure argon (99%) was also tested with gas pressure 1 bar. After melting, the melt was poured out onto a ceramic or graphite pattern at to a temperature no more than 200° C. for fast cooling. Higher temperature patterns create gaps and caves in the final material.

In another similar experiment, the product obtained in the arc furnace was powdered, the powder was pressed and heated in an induction furnace wherein the pressed powder was suspended in a magnetic field to melt. After the melting, the magnetic field was removed and the melt is poured out into a pattern of a temperature not more than 200° C. This approach allowed rapid cooling of the melt.

The obtained material had a high temperature conductivity 8.8 $mm^2$/° C. (compared with 1.8 $mm^2$/° C. for NiSb and 12 $mm^2$/° C. for Fe). The obtained density was found 6.23 g/$cm^3$, being about 99% of the measured X-ray density.

EXAMPLE 2

The compound TiSb was synthesized in an arc furnace as it was described in Example 1. The obtained composition contained 44% of Sb in atomic units with the remainder Ti.

The obtained material was powdered to a particle size not more than 100 μm. The obtained powder was inserted into a container made of titanium alloy VT-01 (contents of all the impurities, mainly Fe and O, is about 1%). The container had an inner diameter 40 mm, 30 mm height, wall thickness was 5 mm. The container was put into a vacuum camera, then closed with a cover made of the same titanium alloy and welded with an electron beam. Afterwards the container was transferred directly to a gas static camera and heated at 910° C. under a pressure of 152 MPa for 1.5 hours. During this procedure, the container was pressed and deformed. The titanium cover was cut with a diamond disk in an inert atmosphere to prevent the composition from burning.

The obtained material could be used to prepare a target of the appropriate size.

X-ray investigation demonstrated the presence of TiSb, as well as $Ti_5Sb_3$ and $Ti_6Sb_5$. The density was found 6.63 g/$cm^3$.

The formed alloy is suitable for use as a target to produce $^{117m}$Sn and other isotopes in a beam of accelerated particles.

Other variations and embodiments will be apparent to one of ordinary skill in the art from the above description and examples. Thus, the foregoing embodiments are not to be construed as limiting the scope of the following claims.

While the foregoing description has set forth certain embodiments of the present invention in particular detail, it must be understood that numerous modifications, substitutions, and changes can be undertaken without departing from the true spirit and scope of the present invention as defined by the ensuing claims. The invention is therefore not limited to specific embodiments as described but is only limited as defined by the following claims.

What is claimed is:

1. A method for producing a target material of an intermetallic compound of antimony and titanium for radionuclide production, the method comprising (a) combining and melting elemental Ti and elemental Sb to form a TiSb alloy, and (b) cooling and solidifying said TiSb alloy, (c) wherein said TiSb alloy is ground to form a powder; and (d) subsequently melting said TiSb alloy powder in an induction furnace at 1160-1500° C.

2. The method of claim 1 wherein the step of melting in the induction furnace is preformed at a pressure of $10^{-2}$ torr or less.

3. The method of claim 1 wherein the step of melting in the induction furnace is performed in an inert gas with a purity no less than 99%.

4. The method of claim 1 wherein after melting in said induction furnace the melt is poured onto a pattern said pattern having a temperature of not more than 200° C.

5. A method for producing a target material of an intermetallic compound of antimony and titanium for radionuclide production the method comprising combining and melting elements Ti and Sb to form a TiSb alloy, cooling and solidifying said TiSb alloy, wherein said TiSb alloy is ground to form a powder, the powder is pressed and heated in said induction furnace while holding the pressed powder suspended in an magnetic field in said induction furnace to form a melt at 1160-1500° C., and subsequently removing said magnetic field and pouring said melt into a pattern preheated to temperature not more than 200° C.

6. The method claimed in claim 1 wherein said powder is subjected to a magnetic field in said induction furnace.

* * * * *

UNITED STATES PATENT AND TRADEMARK OFFICE
Certificate

Patent No. 8,449,816 B2 Patented: May 28, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Yurii D. Seropeghin, Moscow (RU); Boris L. Zhuikov, Moscow Region (RU); and Suresh C. Srivastava, Setauket, NY (US).

Signed and Sealed this Twenty-fifth Day of March 2014.

ROY V. KING
*Supervisory Patent Examiner*
Art Unit 1733
Technology Center 1700